US010330099B2

(12) United States Patent
Schuster et al.

(10) Patent No.: US 10,330,099 B2
(45) Date of Patent: Jun. 25, 2019

(54) HVAC COMPRESSOR PROGNOSTICS

(71) Applicant: Trane International Inc., Davidson, NC (US)

(72) Inventors: Don A. Schuster, Lindale, TX (US); Thomas Reed, Smith, TX (US); Chuan Yan, Tyler, TX (US)

(73) Assignee: Trane International Inc., Davidson, NC (US)

( * ) Notice: Subject to any disclaimer, the term of this patent is extended or adjusted under 35 U.S.C. 154(b) by 378 days.

(21) Appl. No.: 15/088,334

(22) Filed: Apr. 1, 2016

(65) Prior Publication Data

US 2016/0290671 A1 Oct. 6, 2016

Related U.S. Application Data

(60) Provisional application No. 62/141,549, filed on Apr. 1, 2015.

(51) Int. Cl.
*F04C 29/00* (2006.01)
*F04C 18/02* (2006.01)
(Continued)

(52) U.S. Cl.
CPC ..... *F04C 29/0085* (2013.01); *F04B 35/04* (2013.01); *F04C 18/0215* (2013.01);
(Continued)

(58) Field of Classification Search
CPC ..... F04C 29/0085; F04C 18/0215; F04C 18/344; F04B 35/04; F25B 49/022; F25B 49/025; F25B 2700/151; F25B 2700/171; F25B 2700/1931; F25B 2700/1933; F25B 2700/2106; F25B 2700/21151; F25B 2700/21152
(Continued)

(56) References Cited

U.S. PATENT DOCUMENTS 6,184,661 B1 2/2001 Becker et al.
6,318,100 B1 11/2001 Brendel et al.
(Continued)

FOREIGN PATENT DOCUMENTS

EP 1978254 A1 10/2008
GB 2474696 A 4/2011
(Continued)

*Primary Examiner* — Dzung Tran
(74) *Attorney, Agent, or Firm* — The Salerno Law Firm, P.C.

(57) ABSTRACT

Systems and methods for determining the health of a compressor are disclosed. In one embodiment, a prognostic-diagnostic unit (PDU) compares expected compressor power consumption, based on current operating conditions of the HVAC system, to actual compressor power consumption. If the actual power consumption is within a predefined range of the expected power consumption under current operational conditions, the HVAC system is determined to be operating properly. If the actual power consumption deviates from the expected power consumption, a fault is indicated. An appropriate action is taken, such as displaying a fault alert, transmitting a fault message to another device, and storing information relating to the fault for later retrieval to assist troubleshooting.

12 Claims, 4 Drawing Sheets

(51) Int. Cl.
*F04C 18/344* (2006.01)
*F04B 35/04* (2006.01)
*F25B 49/02* (2006.01)

(52) U.S. Cl.
CPC ..... *F04C 18/344* (2013.01); *F25B 49/022* (2013.01); *F25B 49/025* (2013.01); *F25B 2700/151* (2013.01); *F25B 2700/171* (2013.01); *F25B 2700/1931* (2013.01); *F25B 2700/1933* (2013.01); *F25B 2700/2106* (2013.01); *F25B 2700/21151* (2013.01); *F25B 2700/21152* (2013.01)

(58) Field of Classification Search
USPC ..... 702/185, 182
See application file for complete search history.

(56) References Cited

U.S. PATENT DOCUMENTS 6,378,315 B1 4/2002 Gelber et al.
6,487,457 B1* 11/2002 Hull ..... G05B 15/02 700/17
6,679,072 B2 1/2004 Pham et al.
6,868,678 B2 3/2005 Mei et al.
7,114,343 B2 10/2006 Kates
7,188,482 B2 3/2007 Sadegh et al.
7,275,377 B2 10/2007 Kates
7,412,839 B2 8/2008 Jayanth
7,412,842 B2 8/2008 Pham
7,421,850 B2 9/2008 Street et al.
7,469,546 B2 12/2008 Kates
7,484,376 B2 2/2009 Pham
7,634,329 B2 12/2009 Liu et al.
7,644,591 B2 1/2010 Singh et al.
8,322,155 B2 12/2012 Tutunoglu et al.
8,327,656 B2 12/2012 Tutunoglu et al.
8,393,169 B2 3/2013 Pham
8,590,325 B2 11/2013 Pham
8,648,706 B2 2/2014 Ranjan et al.
9,021,819 B2 5/2015 Kates
9,023,136 B2 5/2015 Kates
9,081,394 B2 7/2015 Kates
9,086,704 B2 7/2015 Kates
2005/0171736 A1 8/2005 Kang
2005/0251293 A1* 11/2005 Seigel ..... F24F 11/30 700/276
2005/0252220 A1* 11/2005 Street ..... F25B 49/02 62/129
2006/0036349 A1* 2/2006 Kates ..... F25B 49/005 700/276
2006/0075771 A1 4/2006 Tracey et al.
2009/0039808 A1* 2/2009 Hashimoto ..... F04B 35/04 318/400.02
2012/0316711 A1 12/2012 Christian et al.
2013/0144442 A1 6/2013 Dudley et al.
2013/0176649 A1* 7/2013 Wallis ..... H02H 5/041 361/24
2014/0012422 A1 1/2014 Kates
2014/0069121 A1* 3/2014 Pham ..... F25B 49/005 62/56
2014/0074730 A1 3/2014 Arensmeier et al.
2014/0175181 A1 6/2014 Warren et al.
2014/0262130 A1 9/2014 Yenni et al.
2014/0262134 A1 9/2014 Arensmeier et al.
2014/0266755 A1 9/2014 Arensmeier et al.
2014/0354440 A1 12/2014 Grohman et al.
2016/0215996 A1* 7/2016 Blair ..... G08B 21/187

FOREIGN PATENT DOCUMENTS

JP 2004175290 A 6/2004
JP 2010002090 A 1/2010
WO 2013101701 A1 7/2013

* cited by examiner

HVAC COMPRESSOR PROGNOSTICS

CROSS-REFERENCE TO RELATED APPLICATION

This application claims the benefit of and priority to U.S. Provisional Application Ser. No. 62/141,549 entitled "HVAC COMPRESSOR PROGNOSTICS" and filed Apr. 1, 2015, the entirety of which is hereby incorporated by reference herein for all purposes.

BACKGROUND

1. Technical Field

The present disclosure is directed to improving the reliability of HVAC systems, and in particular, to improved systems, apparatus, and methods for monitoring HVAC compressor performance to identify potential or imminent failures before they can occur.

2. Background of Related Art

Air conditioning and heat pump systems, sometimes referred to as heating, ventilation, and air conditioning (HVAC) systems, employ the vapor-compression refrigeration cycle to cool or warm indoor air. In the case of an air-conditioning system, refrigerant gas is pressurized by a compressor and flows through a condensing coil. A fan blows air through the condensing coil to move heat from the refrigerant into the outside environment, causing the refrigerant to release heat and condense into liquid form. Refrigerant continues to an evaporator where it expands and vaporizes, absorbing heat from, and thereby cooling, indoor air blown through the evaporator by a second fan. In the case of a heat pump, the cycle is reversed whereby heat is moved from the outside environment to indoor air. The compressor and fans are typically driven by electric motors, which may be driven at a fixed speed or at a variable speed. Variable speed motors may be driven by a variable speed drive (VSD) which utilizes an inverter to vary the frequency of alternating current power delivered to the motor.

Over time, HVAC components are subject to wear and tear or other faults which can cause reduced efficiency, component failure, damage to other system components, or even system shutdowns. A technician responding to a service call faces a number of challenges when troubleshooting an HVAC system, particularly if the underlying problem is intermittent or temperature-related. For example, an HVAC system might fail on a hot and humid day, but if the technician arrives on a cooler day where the failure does not occur, it may be difficult to determine the cause of the failure and the proper remedy. In another scenario, a compressor nearing the end if its service life may be functional albeit at a lower efficiency, which increases operating costs to the homeowner in a manner which is not immediately apparent. In yet another scenario, a refrigerant leak can cause diminished performance, can damage compressor internals, and can be harmful to the environment.

An HVAC system which identifies potential problems before they occur would help maintain the overall effectiveness and reliability of the HVAC system, assist service technicians during troubleshooting, prevent customer dissatisfaction, and be a welcome advance in the art.

SUMMARY

In one aspect, the present disclosure is directed to a method for determining an operational condition of a compressor operatively coupled to an electric motor. The method includes receiving information indicative of an actual input power of the electric motor; receiving information indicative of a compressor speed, a compressor saturated suction temperature, and a compressor saturated discharge temperature; determining a mapped input power from the received compressor speed, the compressor saturated suction temperature, and the compressor saturated discharge temperature; and determining the operational condition of the compressor from the actual input power and the mapped input power.

In some embodiments of the method, receiving information indicative of an actual input power includes receiving the information from an inverter drive coupled to the electric motor. In some embodiments, receiving information indicative of a compressor speed includes receiving the information from an inverter drive coupled to the electric motor.

In some embodiments, the method includes receiving a sensor signal corresponding to a compressor saturated discharge pressure, and mapping the compressor saturated discharge pressure to the compressor saturated discharge temperature. In some embodiments, the method includes receiving a sensor signal corresponding to a compressor saturated suction pressure, and mapping the compressor saturated suction pressure to the compressor saturated suction temperature. In some embodiments, determining the operational condition of the compressor includes determining if the ratio between the actual input power and the mapped input power exceeds a predetermined ratio. In some embodiments, a compressor health message is transmitted. In some embodiments, a compressor health message is issued in response to the exceeding. In some embodiments, the predetermined ratio may be about 1.1:1 and/or about 1.3:1.

In some embodiments, determining the operational condition of the compressor includes determining if the ratio between the actual input power and the mapped input power is less than a predetermined ratio. In some embodiments, the method includes issuing an alert in response to a determination that the mapped input power is less than a predetermined ratio. In some embodiments, the predetermined ratio may be about 0.7:1 and/or about 0.85:1.

In some embodiments, the compressor health message includes information such as, without limitation, one, some, or all of a timestamp, information indicative of the actual input power of the electric motor, information indicative of the compressor speed, information indicative of the compressor saturated discharge temperature, and/or information indicative of the compressor saturated suction temperature.

In some embodiments, the method includes storing, in response to the exceeding, historical information including at least one of a timestamp, information indicative of the actual input power of the electric motor, information indicative of the compressor speed, information indicative of the compressor saturated discharge temperature, and/or information indicative of the compressor saturated suction temperature in a memory device. In some embodiments, the method includes retrieving, from the memory device, the historical information.

In some embodiments, the method includes calculating the mapped input power in accordance with the equation:

$$P_{mapped}=a+b*T_{css}+c*T_{csd}+d*T_{css}^2+e*T_{css}*T_{csd}+f*T_{csd}^2+g*T_{css}^3+h*T_{csd}*T_{css}^2+i*T_{css}*T_{csd}^2+j*T_{csd}^3$$

where $T_{css}$ represents saturated suction temperature and $T_{csd}$ represents saturated discharge temperature.

In another aspect, the present disclosure is directed to an HVAC compressor prognostics system. The disclosed system includes a compressor; an electric motor configured to drive the compressor; and a prognostic-diagnostic unit configured for receiving information indicative of motor input power, compressor speed, compressor saturated discharge temperature, and compressor saturated suction temperature, the prognostic-diagnostic unit further configured to determine an operational condition of the compressor from the received information.

In some embodiments, the prognostic-diagnostic unit is further configured to receive a signal indicative of motor input power from an inverter drive coupled to the electric motor. In some embodiments, the prognostic-diagnostic unit is further configured to receive a signal indicative of compressor speed from an inverter drive coupled to the electric motor. In some embodiments, the prognostic-diagnostic unit is configured for receiving a signal indicative of compressor saturated discharge pressure, and the prognostic-diagnostic unit is further configured to map the compressor saturated discharge pressure to compressor saturated discharge temperature.

In some embodiments, the prognostic-diagnostic unit is configured for receiving a signal indicative of compressor saturated suction pressure, and the prognostic-diagnostic unit is further configured to map the compressor saturated suction pressure to compressor saturated suction temperature. In some embodiments, the prognostic-diagnostic unit is configured for receiving signals indicative of the input current of the electric motor and of the input voltage of the electric motor, and the prognostic-diagnostic unit is further configured to calculate the input power of the electric motor from the signals. In some embodiments, the prognostic-diagnostic unit is configured to determine a mapped input power from the received compressor speed, the compressor saturated discharge temperature, and the compressor saturated suction temperature.

In some embodiments, the prognostic-diagnostic unit is configured for calculating the mapped input power in accordance with the equation:

$$P_{mapped}=a+b*T_{css}+c*T_{csd}+d*T_{css}^2+e*T_{css}*T_{csd}+f*T_{csd}^2+g*T_{css}^3+h*T_{csd}*T_{css}^2+i*T_{css}*T_{csd}^2+j*T_{csd}^3$$

In some embodiments, the prognostic-diagnostic unit is further configured for determining a ratio between motor input power and mapped input power. In some embodiments, the prognostic-diagnostic unit is further configured to transmit a fault signal if the ratio between the motor input power and the mapped input power exceeds a predetermined ratio. In some embodiments, the prognostic-diagnostic unit may be configured to transmit a second fault signal if the ratio between the motor input power and the mapped input power exceeds a second predetermined ratio. In some embodiments, the prognostic-diagnostic unit includes a memory device, and the prognostic-diagnostic unit is configured to store historical information including at least one of a timestamp, information indicative of the actual input power of the electric motor, information indicative of the compressor speed, information indicative of the compressor saturated discharge temperature, and/or information indicative of the compressor saturated suction temperature in the memory device if the ratio between the motor input power and the mapped input power exceeds a predetermined ratio. In some embodiments, the prognostic-diagnostic may transmit historical information from the memory device.

In yet another aspect, the present disclosure is directed to an HVAC compressor prognostic-diagnostic unit. In an embodiment, the HVAC compressor prognostic-diagnostic unit includes a mapping unit configured to receive a saturated suction pressure signal, a saturated discharge pressure signal, and a motor speed signal. The mapping unit is further configured to compute a mapped power from the saturated suction pressure signal, a saturated discharge pressure signal, and a motor speed signal. HVAC compressor prognostic-diagnostic unit includes a power determination unit configured to compute a motor input power. The HVAC compressor prognostic-diagnostic unit includes a comparison unit operatively coupled to the mapping unit and the power determination unit. The comparison unit is configured to receive the mapped power and the motor input power, and to compare the motor input power to the mapped motor input power to determine an operational condition of the compressor. The HVAC compressor prognostic-diagnostic unit includes a memory unit operatively coupled to the comparison unit and configured to stored the operational condition of the compressor, and an output unit operatively coupled to the comparison unit and/or the memory unit and configured to transmit the operational condition of the compressor.

BRIEF DESCRIPTION OF THE DRAWINGS

Various embodiments of the disclosed system and method are described herein with reference to the drawings wherein.

Figure 1:
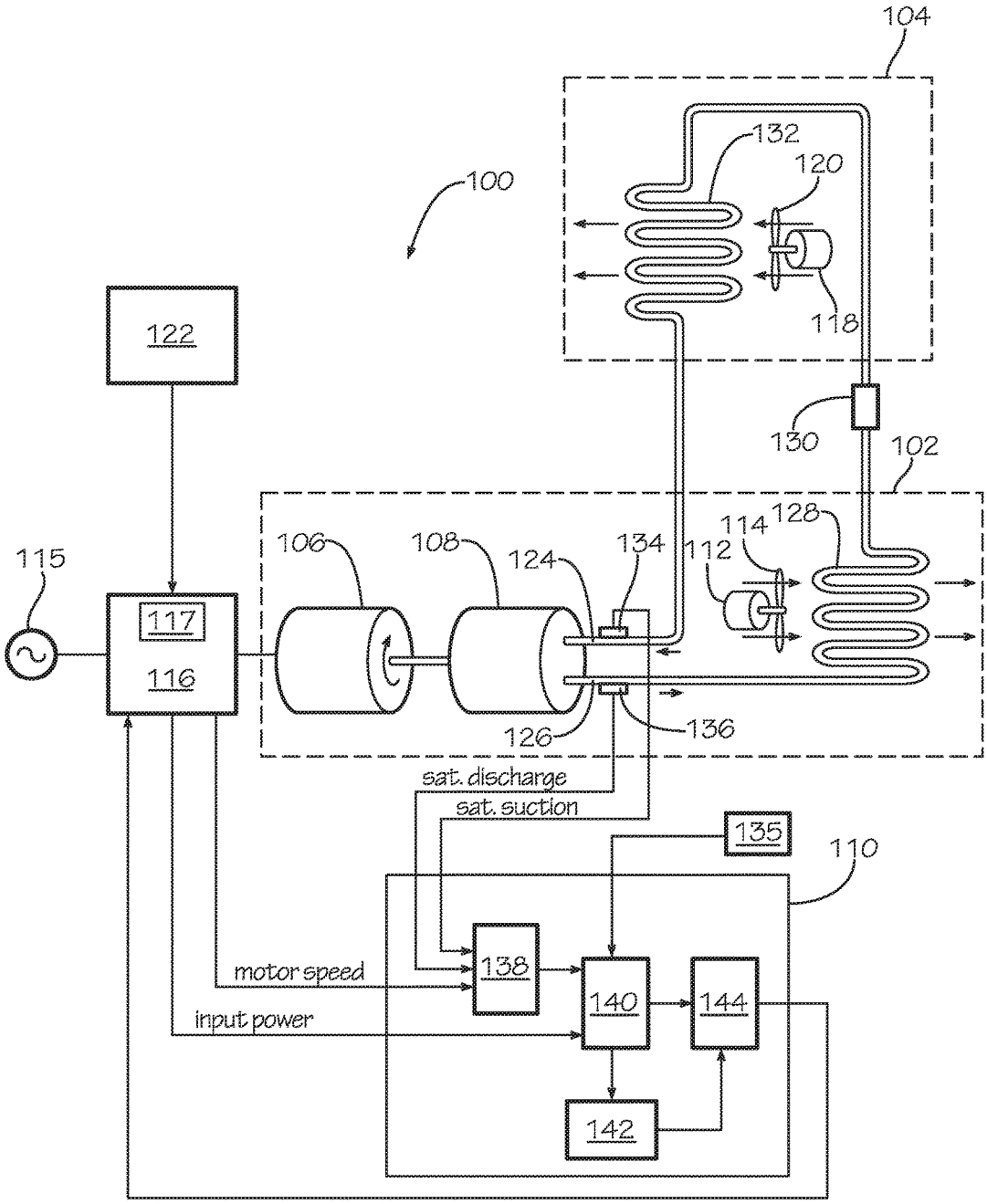
FIG. 1 is a schematic diagram of an HVAC system incorporating a compressor prognostics system in accordance with an embodiment of the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements which may perform the same, similar, or equivalent functions. The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary."

The present disclosure is described herein in terms of functional block components and various processing steps. It should be appreciated that such functional blocks configured to perform the specified functions may be embodied in mechanical devices, electromechanical devices, analog circuitry, digital circuitry, and/or instructions executable on a processor. For example, the present disclosure may employ various discrete components, integrated circuit components (e.g., memory elements, processing elements, logic elements, look-up tables, and the like) which may carry out a variety of functions, whether independently, in cooperation with one or more other components, and/or under the control of one or more processors or other control devices. It should be appreciated that the particular implementations described herein are illustrative of the disclosure and its best mode and are not intended to otherwise limit the scope of the present disclosure in any way.

Embodiments of the present disclosure are directed to a prognostic-diagnostic unit (PDU) that compares expected compressor power consumption, based on current operating conditions of the HVAC system, to actual compressor power consumption. If the actual power consumption is within a predefined range of the expected power consumption, the HVAC system is determined to be operating properly, e.g., operating without any immediate or expected faults. Conversely, if the actual power consumption deviates from the expected power consumption by more than a predetermined amount, a fault is indicated. In this case, an appropriate action is taken, such as displaying a fault alert, transmitting a fault message to another device, storing information relating to the fault for later retrieval to assist troubleshooting, and so forth.

The relationship between the expected and actual power consumption, such as whether the actual power consumption is higher, lower, trending higher, or trending lower than the expected power consumption may provide additional detail as to the nature of an impending fault condition.

In one non-limiting example, a common compressor failure is caused by increased internal friction of compression elements (rotors, vanes, pistons, scrolls, etc.) or shaft bearings. Such increased internal friction causes input power to be converted to heat rather than perform useful compression work, which overheats the compressor and accelerates its failure. In this instance, input power will be greater than the expected power since some of the input power is being used to overcome increased friction rather than for performing work. The PDU will detect this imbalance and flag a fault condition indicating possible compressor failure.

In another non-limiting example, a mechanical failure within a compressor may cause input power to be less than expected. In this instance, the PDU will detect this imbalance and flag a fault condition indicating possible compressor failure.

In more detail, and with reference to FIG. 1, an example embodiment of a prognostic-diagnostic unit (PDU) 110 in accordance with the present disclosure is shown. PDU 110 is operatively associated with HVAC system 100 that includes an outdoor unit 102 and an indoor unit 104. Outdoor unit 102 includes an electric motor 106 operatively engaged in rotational communication with compressor 108; and an electric motor 112 configured to drive fan 114. Outdoor unit 102 includes a variable frequency inverter drive unit (VSD) 116 configured to drive electric motor 106, and thus compressor 108, at variable speed. VSD 116 receives power from utility 115. VSD 116 is operatively coupled to a thermostat 122 or other suitable setpoint controller which activates and deactivates VSD 116 and motor 106 as required to maintain a desired setpoint temperature. A communications display assembly (CDA) 117 is operatively associated with VSD 116 and is configured to receive and display data relating to HVAC system 100, including operational, configuration, and diagnostic data. Outdoor unit 102 includes a second VSD unit (not explicitly shown) that drives motor 112 and fan 114 at variable speed to circulate outdoor air through condenser 128. Indoor unit 104, sometimes referred to as an air handler, includes an electric motor 118 that drives blower 120 to circulate indoor air through evaporator 132.

In use, outdoor unit 102 and indoor unit 104 interoperate to perform a vapor compression refrigeration cycle. Circulating refrigerant, such as R-410A, enters compressor 108 through inlet 124 as saturated vapor. Compressor 108 increases the pressure and temperature of the refrigerant resulting in superheated vapor which exits compressor 108 via outlet 126. Superheated vapor flows through condenser 128, where the superheated refrigerant vapor is cooled and condensed into saturated liquid form, moving heat from the refrigerant into outside air driven through condenser 128 by fan 114. The refrigerant then passes through expansion valve 130 where it undergoes an abrupt reduction in pressure causing adiabatic flash evaporation of a portion of the liquid refrigerant, which, in turn, lowers the temperature of the liquid and vapor refrigerant mixture. The cold liquid and vapor mixture flows through the evaporator 132. Blower 120 circulates warm indoor air through evaporator 132. Heat from the indoor air is transferred into the refrigerant, causing it to expand and vaporize, cooling the indoor air. Warm refrigerant vapor exiting evaporator 132 returns to compressor 108, and the vapor compression refrigeration cycle continues.

It should be understood that, while the present example embodiment illustrates HVAC system 100 configured as an air conditioning system, HVAC system 100 may be configured as a heat pump system.

A suction sensor 134 is operatively associated with compressor inlet 124 and configured to sense a property of the saturated refrigerant vapor as it enters compressor 108. In the example embodiment shown in FIG. 1, suction sensor 134 is configured to sense the pressure of the refrigerant as it enters compressor 108. In some embodiments, suction sensor 134 is configured to sense refrigerant temperature. A discharge sensor 136 is operatively associated with compressor outlet 126 and configured to sense a property of the superheated saturated refrigerant vapor as it exits compressor 108. In the example embodiment shown in FIG. 1, discharge sensor 136 is configured to sense refrigerant pressure as it exits compressor 108. In some embodiments, discharge sensor 136 is configured to sense exiting refrigerant temperature. Since refrigerant pressure at inlet 124 and/or outlet 126 is directly related to refrigerant temperature, the sensed pressure values are readily converted to temperature, or may be used in place of temperature, by employing a conversion coefficient or conversion formula known in the art.

The example embodiment illustrated by PDU 110 includes a mapping unit 138 that is configured to receive a saturated suction pressure signal received from suction sensor 134, a saturated discharge pressure signal received from discharge sensor 136, and a motor speed signal received from VSD 116. The received signals operate to provide mapping unit 138 with terms used to calculate mapped input power. In the present embodiment, the saturated suction pressure signal operates to provide saturated suction temperature $T_{css}$, the saturated discharge pressure signal operates to provide saturated discharge temperature $T_{csd}$, and the motor speed signal operates to provide compressor speed $S_c$.

In embodiments where mapping unit 138 receives an analog signal from suction sensor 134, discharge sensor 136, and/or VSD 116, mapping unit 138 converts the analog signal received into a corresponding digital signal, and stores the resulting digital signal indicative of the respective measured or calculated refrigerant suction temperature, refrigerant discharge temperature, and/or compressor speed.

Mapping unit 138 calculates the mapped input power using equation (1) presented below where constants a through j are empirical coefficients:

$$P_{mapped}=(a+b*T_{css}+c*T_{csd}+d*T_{css}^2+e*T_{css}*T_{csd}+f*T_{csd}^2+g*T_{css}^3+h*T_{csd}*T_{css}^2+i*T_{css}*T_{csd}^2+j*T_{csd}^3) \quad (1)$$

In some embodiments, mapping unit 138 calculates the mapped input power using $T_{css}$ and $T_{csd}$ as indices into a pre-programmed data structure (array, database, etc.) in which the expected relationships between saturated suction pressure, saturated discharge pressure, and discrete compressor speeds to the expected (mapped) input power is encoded. The mapped input power is transmitted to comparison unit 140.

To determine empirical coefficients a through j and/or to pre-program the data structure, outdoor unit 102 and/or subcomponents thereof (e.g., motor 106 and compressor 108) are evaluated using the calorimetric method under test conditions which simulate the operating conditions under which the system is intended to operate, as will be familiar to the skilled practitioner. In embodiments, multiple sets of coefficients are created, each set for a specific compressor speed. During use, the speed-specific data sets may be interpolated to determine $P_{mapped}$ for compressor speeds falling between the particular speeds at which the coefficient data sets were generated.

Embodiments of the present disclosure may be advantageously utilized with HVAC systems having a wide range of capacities, therefore it is envisioned that coefficients a through k, and/or the pre-programming of the data structure are determined in connection with a particular configuration (e.g., production model) of outdoor unit 102 with which the disclosed prognostic system is utilized.

PDU 110 includes a comparison unit 140 that is configured to receive an input power signal that represents the actual input power $P_{input}$ supplied to motor 106 from VSD 116 and the mapped power signal transmitted by mapping unit 138. In some embodiments where an analog input power signal is received from VSD 116, comparison unit 140 is configured to convert the analog input power signal into a corresponding digital signal. Comparison unit 140 is additionally configured to receive an ambient temperature signal from ambient temperature sensor 135. Comparison unit 140 then compares the actual input power reported by VSD 116 to the mapped (expected) input power computed by mapping unit 138 to determine the operational condition of the compressor. In the present embodiment, comparison unit 140 determines if the ratio $P_{input}$:$P_{mapped}$ (e.g., the ratio between actual input power and mapped input power) exceeds a predetermined ratio. For example, if the $P_{input}$:$P_{mapped}$ is less than 1.1:1, it is determined that compressor 108 is operating normally. If, however $P_{input}$:$P_{mapped}$ is 1.1:1 or greater (e.g., actual input power is greater than 1.1 times mapped input power), it is concluded that compressor 108 is operating in a pre-fault condition, and in response, comparison unit 140 transmits a fault signal. In embodiments, the amount by which the actual input power exceeds the mapped input power may be quantified into a fault severity signal indicative of compressor health whereby as the ratio of actual to mapped compressor power increases, the severity of the fault signal increases. Quantifying fault severity in this manner may assist in evaluating the probability and timing of a compressor failure, in addition to providing diagnostic information to a technician. Fault severity may also be employed to assess the urgency of needed repairs, which enables service providers to better allocate and prioritize resources (e.g., technician time and replacement parts) to those HVAC systems most in need of attention. The fault severity signal may be included within the fault signal.

PDU 110 includes a memory unit 142 and output unit 144 in operative communication with comparison unit 140. Comparison unit 140 is configured such that, when a fault is detected, information relating to the fault is transmitted to memory unit 142, which stores the fault information for later retrieval. Fault information transmitted to comparison unit and/or stored in memory unit 142 may include any, some, or all of, without limitation, the date and time of the fault occurrence, actual input power, mapped power, compressor speed, saturated suction pressure, saturated suction temperature, saturated discharge pressure, saturated discharge temperature, fault severity, ambient temperature, and so forth. In some embodiments, historical information may be stored in the absence of a fault to maintain a record of the operational parameters received by PDU 110 corresponding to normal or acceptable operating conditions. Such information may be stored and/or transmitted on a periodic basis to confirm that compressor 108 is in good operating condition.

Information relating to the health of compressor 108 (which may indicate the presence or absence of a fault) may additionally or alternatively be transmitted via output unit 144. In the example embodiment shown in FIG. 1, output unit 144 is in operative communication with VSD 116. VSD 116 is configured for receiving fault signals from PDU 110, which may be displayed on CDA 117 in response to user inputs received thereat from a user, typically an HVAC technician or facilities engineer. In embodiments, VSD 116 and PDU 110 may be configured for bidirectional communications whereby a technician inputs a request for historical fault information into CDA 117 which is transmitted to PDU 110. PDU 110 responds to the request by retrieving stored fault information from memory unit 142, which, in turn, is transmitted to VSD 116 for display on CDU 117. In some embodiments, PDU 110 is configured to transmit predetermined mapping information to VSD 116 for display on CDU 117. In these embodiments, a technician has the option to compare measurements manually obtained from the technician's test equipment to expected values for the system under test provided by PDU 110 and displayed on CDU 117. In this manner, the fault indications provided by PDU 110 may be confirmed by the technician, and/or may facilitate troubleshooting of other malfunctions which may otherwise elude detection.

Output unit 144 may include a wired or wireless communications interface, and may include the capability to communicate using any suitable communication protocol, including without limitation Ethernet, RS-485, CANBus, 802.11WiFi, 802.15.4 personal area networks (Z-Wave®, ZigBee®), and so forth.

Figure 2:
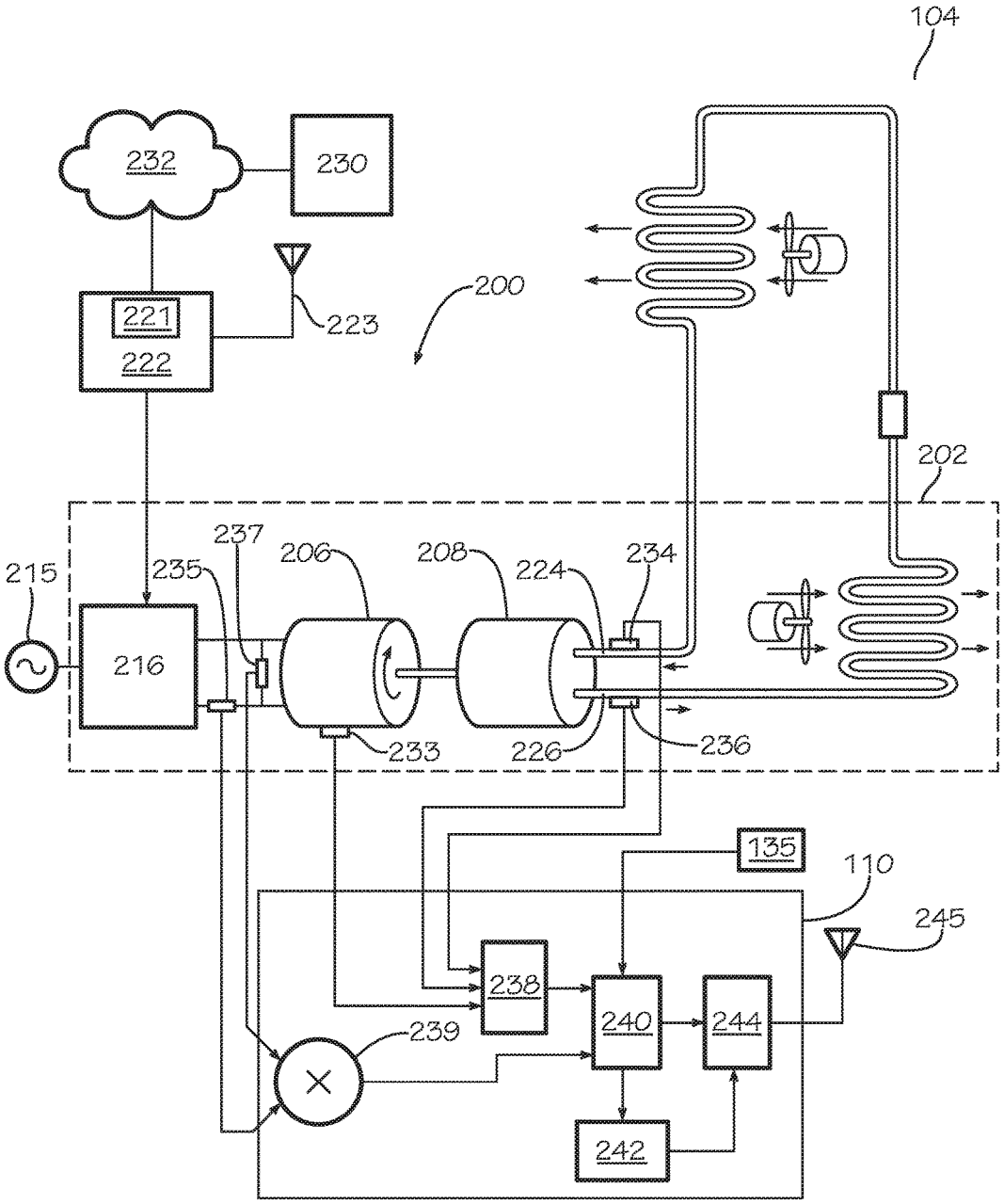
FIG. 2 is a schematic diagram of an HVAC system incorporating a compressor prognostics system in accordance with another embodiment of the present disclosure.

FIG. 2 illustrates a PDU 210 that is operatively associated with an HVAC system 200 in accordance with another embodiment of the present disclosure. In this embodiment, PDU 210 and thermostat 222 are configured to communicate fault signals to a homeowner and/or or a service provider. HVAC system 200 of FIG. 2 is substantially similar to the FIG. 1 example, and includes outdoor unit 202 having an electric motor 206 that drives compressor 208. HVAC system 200 includes a control unit 216 that is in operative communication with thermostat 222 to receive system control commands (e.g., compressor on/off, compressor speed, etc.) transmitted by thermostat 222 in response to environmental conditions within the building and setpoint temperature. Thermostat 222 is additionally configured for communication with a remote database 230 via network 232, such as the public internet. Thermostat 222 includes a communications interface 223 that is configured to communicate with PDU 210 via a corresponding communications interface 245 operatively coupled to output unit 244. Thermostat 222 includes a user interface 221 having a display assembly and a user input assembly, such as, without limitation, an LCD display panel, a speaker or other audio output device, one or more buttons, rotary controls and/or switches, and/or a touchscreen device.

Utility power 215 is delivered to control unit 216, which selectively provides input power to motor 206 in response to control signals received from thermostat 222. In some embodiments where motor 206 is a variable speed motor, control unit 216 includes a variable speed inverter drive that is configured for driving motor 206 at a variable speed. In some embodiments, where motor 206 is a single speed motor, control unit 216 may contain an electromagnetic relay, solid state relay, or other suitable switching device configured to selectively deliver power to motor 206.

Current sensor 235 is coupled in series between control unit 216 and motor 206, and is configured to provide a current sensor signal indicative of the input current of motor 206 to a power determination unit 239 included in PDU 210. Voltage sensor 237 is coupled in parallel with motor 206, and is configured to provide a voltage sensor signal indicative of the input voltage to motor 206 to power determination unit 239. Power determination unit 239 is configured to compute the actual input power to motor 206 from the current sensor signal and the voltage sensor signal.

A motor speed sensor 233 is operatively associated with motor 206 and configured to provide a speed sensor signal to mapping unit 238. Motor speed sensor 233 may include any suitable rotational speed sensing device, such as an optical tachometer, magnetic or hall-effect tachometer, and/or may determine motor speed via back EMF measurement. A suction sensor 234 is operatively associated with compressor inlet 224 and configured to sense a property of the saturated refrigerant vapor as it enters compressor 208. A discharge sensor 236 is operatively associated with compressor outlet 226 and configured to sense a property of the superheated saturated refrigerant vapor as it exits compressor 208.

Mapping unit 238 is configured to receive a saturated suction pressure signal received from suction sensor 234, a saturated discharge pressure signal received from discharge sensor 236, and a speed sensor signal received from speed sensor 233. The received signals operate to provide mapping unit 238 with terms used to calculate mapped input power. In the present embodiment, the saturated suction pressure signal operates to provide saturated suction temperature $T_{css}$, the saturated discharge pressure signal operates to provide saturated discharge temperature $T_{csd}$, and the speed sensor signal operates to provide compressor speed $S_c$.

Comparison unit 240 is configure to compare the actual input power computed by power determination unit 239 to the mapped (expected) input power computed by mapping unit 238 to determine if a pre-fault or fault compressor condition is indicated as described hereinabove. In response to a determination that a pre-fault or fault condition exists, comparison unit 240 transmits fault information to memory unit 242, which stores the fault information for later retrieval. Fault information may additionally or alternatively be transmitted via output unit 244 and communications interface 245. In this embodiment, fault information is wirelessly transmitted to thermostat 222. In some embodiments, thermostat 222 is configured to display a fault message on user interface 221 in response to receipt of fault information from PDU 210. The fault message may include a visual indication, such as a textual message and/or an icon, and/or an alert sound. In some embodiments, thermostat 222 transmits the fault information to database 230. In some embodiments, the user is presented with a choice of whether to transmit the fault information to a service provider. In response to an affirmative choice, thermostat 222 transmits the fault information to a database 230 that is accessible by the service provider. The service provider may choose to take action, including without limitation, contacting the homeowner to schedule a service call, soliciting additional diagnostic information from HVAC system 200, and/or causing thermostat 222 to display an informational message to the user. In some embodiments, thermostat 222 provides an interactive service appointment scheduler that enables the service provider and user to collaboratively schedule a service call.

Figure 3:
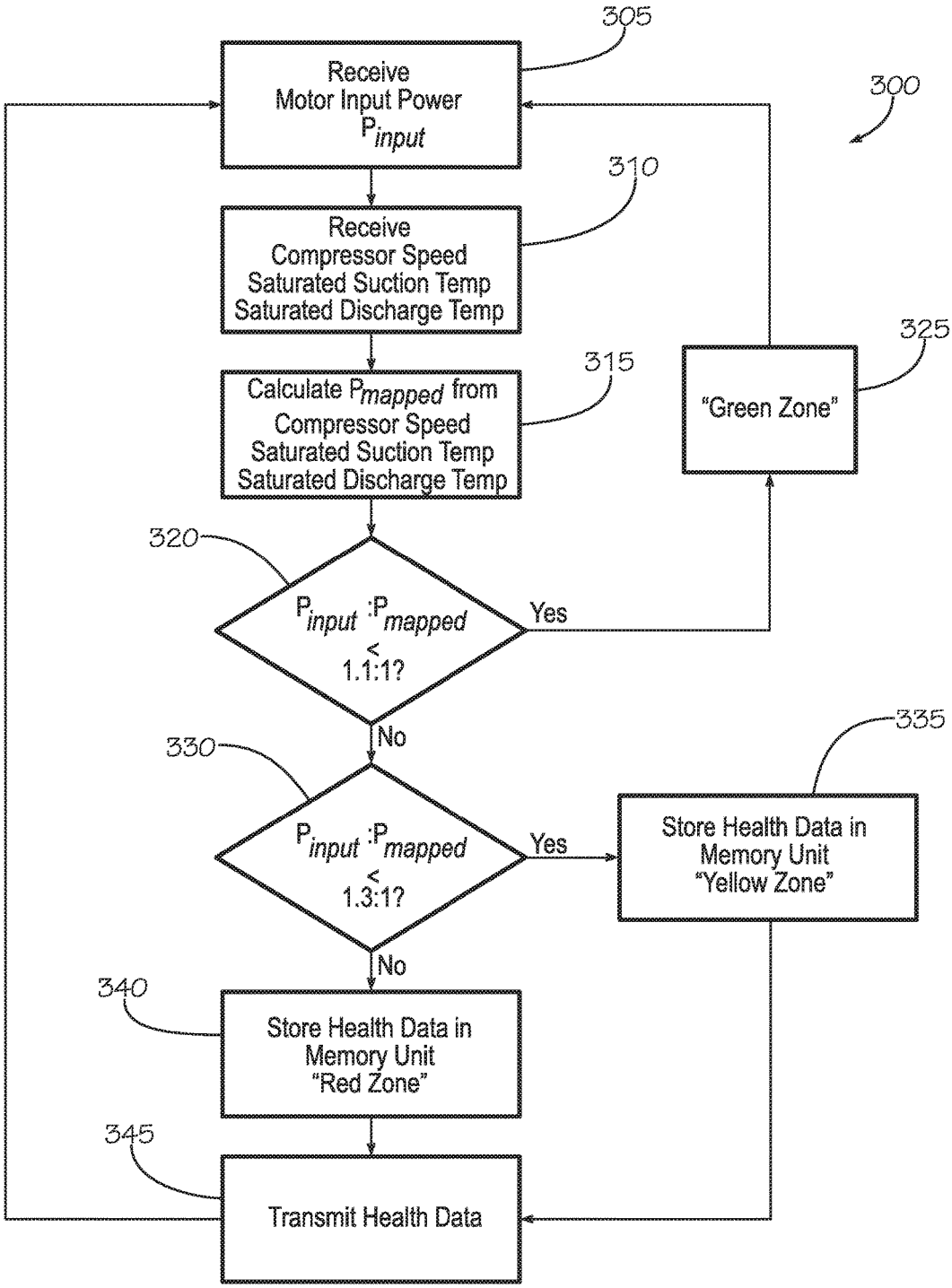
FIG. 3 depicts a flowchart illustrating a method of assessing compressor health in accordance with an embodiment of the present disclosure.

Turning now to FIG. 3, a method 300 of determining an operational condition of an HVAC compressor is illustrated wherein the health of the compressor is characterized into three "health" zones. The method 300 begins in step 305 where a motor input power $P_{input}$ is received. $P_{input}$ indicates the actual input power delivered to an electric motor that drives the subject HVAC compressor. $P_{input}$ may be obtained from a data port provided on a variable speed inverter drive unit (VSD) and/or derived from one or more sensors electrically associated with the motor and configured to sense an electrical property of the motor, such as current, voltage, Watts, VA, etc. A power factor correction may be applied to a measured property or a power value derived therefrom. In step 310, the compressor speed (e.g., the rotational speed of the compressor shaft), the saturated suction temperature, and the saturated discharge temperature are obtained. In some embodiments, the saturated suction pressure and/or the saturated discharge pressure may be obtained and converted to saturated suction temperature and/or saturated discharge temperature, respectively.

In step 315, the mapped (expected) input power $P_{mapped}$ is determined. In some embodiments, $P_{mapped}$ is computed using formula (1) discussed above. In some embodiments, $P_{mapped}$ is determined using a preprogrammed lookup tabled stored in a memory device. In steps 320 and 330 the ratio of $P_{input}$:$P_{mapped}$ is evaluated. In step 320, if $P_{input}$:$P_{mapped}$ is less than 1.1:1, the compressor is determined to be operating normally, and therefore the health of the compressor is said to be in the "green zone" (step 325). In some embodiments, in step 325 a "healthy compressor" ("green zone") message is caused to be displayed on a thermostat or other device having a suitable user interface that is operatively associated with the compressor. The method iterates to step 305 where the process repeats. Additionally or alternatively, health data may be transmitted to indicate that the compressor is operating normally.

If, in step 320, $P_{input}$:$P_{mapped}$ is not less than 1.1:1, then in step 330, the ratio of $P_{input}$:$P_{mapped}$ is evaluated to determine whether $P_{input}$:$P_{mapped}$ is less than 1.3:1. If $P_{input}$:$P_{mapped}$ is less than 1.3:1 (e.g., $P_{input}$:$P_{mapped}$ is at least 1.1:1 but no more than 1.3:1) the compressor is determined to be in a level 1 pre-fault condition, and therefore the health of the compressor is said to be in the "yellow zone." In step 335, compressor health data is stored in a memory unit. Compressor health data may include, but is not limited to, any, some, or all of a timestamp indicating the date and time of the detected fault, information indicative of the actual input power of the electric motor, information indicative of the compressor speed, information indicative of the compressor saturated discharge temperature, information indicative of the compressor saturated suction temperature, and/or information indicative of an environmental condition (indoor temperature, indoor humidity, outdoor temperature, outdoor humidity, etc.). In some embodiments, a "yellow zone" health message may be caused to be displayed on a user interface, as described above. In step 345, compressor health data is transmitted to a device, such as without limitation, a thermostat, a diagnostic device, and/or a service provider database, and the process iterates to step 305.

If, in step 330, it is determined that the ratio of $P_{input}$:$P_{mapped}$ is 1.3:1 or greater, then the compressor is determined to be in a level 2 pre-fault condition, and the health of the compressor is said to be in the "red zone." In step 340, the compressor health data is stored in a memory unit as described above. In some embodiments, a "red zone" health message may be caused to be displayed on a user interface, as described above, and the method proceeds with transmission step 345, and iterates to step 305.

It should be appreciated that embodiments of the present disclosure may employ greater or fewer health characterization zones than the example embodiment described herein, and may employ ratio thresholds other than 1.1:1 and 1.3:1 to demarcate the various health zones.

For example, embodiments of the present disclosure may additionally or alternatively be configured to detect a malfunction(s) which causes $P_{input}$ to be undesirably less than $P_{mapped}$. In these embodiments, the "red zone" may additionally or alternatively be defined as when $P_{input}$:$P_{mapped}$ is determined to be 0.7:1 or less. The "yellow zone" may additionally or alternatively be defined as when $P_{input}$:$P_{mapped}$ is determined to be between 0.7:1 and 0.85:1.

It should be appreciated that aspects of the present disclosure may embodied in a user device, such as handheld diagnostic device, and/or a software application executable on a computing device such as a smart phone, tablet computer, or notebook computer. In these embodiments, a technician has the ability to input into the user device the motor input power, compressor speed, saturated suction temperature, and saturated discharge temperature. In embodiments, a camera included within the user device may be employed as an optical tachometer to facilitate measurement of compressor speed. A software application that includes instructions for performing the methods described herein executes on a processor included in the user device to receive the measured parameters and to generate a diagnostic health message.

Figure 4:
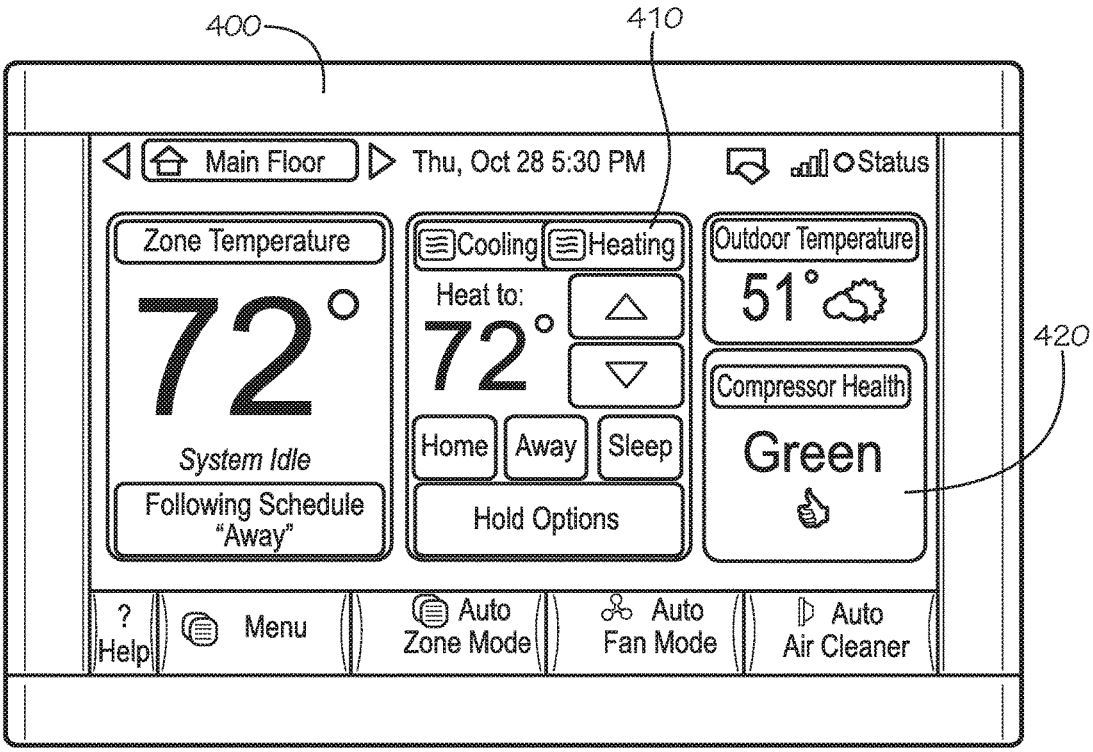
FIG. 4 shows a thermostat configured to receive and display compressor health in accordance with an embodiment of the present disclosure.

FIG. 4 illustrates an example embodiment of a device 400 that is configured to display compressor health. In the present embodiment, device 400 is depicted as a wall-mounted thermostat having a touchscreen user interface 410, however device 400 may include any device having a suitable user interface display, for example, CDA 117 and/or VDU 116. Device 400 receives health data that has been transmitted as described above, e.g., from PDU 110, from PDU 220, and/or from a device which performs method 300. In response to receiving the health data, device 400 displays a health message 420 on user interface 420. As can be seen in FIG. 4, health message 420 indicates the HVAC compressor is operating normally, in the "green zone." Health messages which indicate operating conditions, e.g., "yellow zone" messages, "red zone" message and/or messages containing additional information such as compressor speed, suction and discharge temperatures and pressures, input power, and so forth may additionally or alternative be displayed in response to received health data. In some embodiments, device 400 includes a speaker or other audio output device that is configured to issue an alert sound when compressor health is in a fault zone (e.g., yellow or red). In these embodiments, the alert sound is repeated on a periodic basis until acknowledged or canceled by a user.

ASPECTS

It is noted that any of aspects 1-11, any of aspects 12-27, and/or aspect 28 may be combined with each other in any combination.

Aspect 1. A method for determining an operational condition of a compressor operatively coupled to an electric motor, comprising receiving information indicative of an actual input power of the electric motor; receiving information indicative of a compressor speed, a compressor saturated suction temperature, and a compressor saturated discharge temperature; determining a mapped input power from the received compressor speed, the compressor saturated suction temperature, and the compressor saturated discharge temperature; and determining the operational condition of the compressor from the actual input power and the mapped input power.

Aspect 2. The method in accordance with aspect 1, wherein receiving information indicative of an actual input power includes receiving the information from an inverter drive coupled to the electric motor.

Aspect 3. The method in accordance with any of aspects 1-2, wherein receiving information indicative of a compressor speed includes receiving the information from an inverter drive coupled to the electric motor.

Aspect 4. The method in accordance with any of aspects 1-3, further comprising receiving a sensor signal corresponding to a compressor saturated discharge pressure; and mapping the compressor saturated discharge pressure to the compressor saturated discharge temperature.

Aspect 5. The method in accordance with any of aspects 1-4, further comprising receiving a sensor signal corresponding to a compressor saturated suction pressure; and mapping the compressor saturated suction pressure to the compressor saturated suction temperature.

Aspect 6. The method in accordance with any of aspects 1-5, wherein determining the operational condition of the compressor includes determining if the ratio between the actual input power and the mapped input power exceeds a predetermined ratio.

Aspect 7. The method in accordance with any of aspects 1-6, further comprising issuing an alert in response to the exceeding.

Aspect 8. The method in accordance with any of aspects 1-7, wherein the predetermined ratio is selected from the group consisting of about 1.1:1 and about 1.3:1.

Aspect 9. The method in accordance with any of aspects 1-8, wherein determining the operational condition of the compressor includes determining if the ratio between the actual input power and the mapped input power is less than a predetermined ratio.

Aspect 10. The method in accordance with any of aspects 1-9, further comprising issuing an alert in response to a determination that the mapped input power is less than a predetermined ratio.

Aspect 11. The method in accordance with any of aspects 1-10, wherein the predetermined ratio is selected from the group consisting of about 0.7:1 and about 0.85:1.

Aspect 12. The method in accordance with any of aspects 1-11, further comprising storing, in response to the exceeding, historical information including at least one of a timestamp, information indicative of the actual input power of the electric motor, information indicative of the compressor speed, information indicative of the compressor saturated discharge temperature, and/or information indicative of the compressor saturated suction temperature in a memory device.

Aspect 13. The method in accordance with any of aspects 1-12, further comprising retrieving, from the memory device, the historical information.

Aspect 14. The method in accordance with any of aspects 1-13, wherein determining a mapped input power includes calculating the mapped input power in accordance with the equation:

$$P_{mapped}=a+b*T_{css}+c*T_{csd}+d*T_{css}^2+e*T_{css}*T_{csd}+f*T_{csd}^2+g*T_{css}^3+h*T_{csd}*T_{css}^2+i*T_{css}*T_{csd}^2+j*T_{csd}^3$$

Aspect 15. An HVAC compressor prognostics system, comprising a compressor; an electric motor configured to drive the compressor; and a prognostic-diagnostic unit configured for receiving information indicative of motor input power, compressor speed, compressor saturated discharge temperature, and compressor saturated suction temperature, the prognostic-diagnostic unit further configured to determine an operational condition of the compressor from the received information.

Aspect 16. The HVAC compressor prognostics system in accordance with aspect 15, wherein the prognostic-diagnostic unit is further configured to receive a signal indicative of motor input power from an inverter drive coupled to the electric motor.

Aspect 17. The HVAC compressor prognostics system in accordance with any of aspects 15-16, wherein the prognostic-diagnostic unit is further configured to receive a signal indicative of compressor speed from an inverter drive coupled to the electric motor.

Aspect 18. The HVAC compressor prognostics system in accordance with any of aspects 15-17, wherein the prognostic-diagnostic unit is configured for receiving a signal indicative of compressor saturated discharge pressure and wherein the prognostic-diagnostic unit is further configured to map the compressor saturated discharge pressure to compressor saturated discharge temperature.

Aspect 19. The HVAC compressor prognostics system in accordance with any of aspects 15-18, wherein the prognostic-diagnostic unit is configured for receiving a signal indicative of compressor saturated suction pressure and wherein the prognostic-diagnostic unit is further configured to map the compressor saturated suction pressure to compressor saturated suction temperature.

Aspect 20. The HVAC compressor prognostics system in accordance with any of aspects 15-19 wherein the prognostic-diagnostic unit is further configured for receiving signals indicative of the input current of the electric motor and of the input voltage of the electric motor, and wherein the prognostic-diagnostic unit is further configured to calculate the input power of the electric motor from the signals.

Aspect 21. The HVAC compressor prognostics system in accordance with any of aspects 15-20 wherein the prognostic-diagnostic unit is further configured to determine a mapped input power from the received compressor speed, the compressor saturated discharge temperature, and the compressor saturated suction temperature.

Aspect 22. The HVAC compressor prognostics system in accordance with any of aspects 15-21 wherein the prognostic-diagnostic unit is further configured for calculating the mapped input power in accordance with the equation:

$$P_{mapped}=a+b*T_{css}+c*T_{csd}+d*T_{css}^2+e*T_{css}*T_{csd}+f*T_{csd}+g*T_{css}^3+h*T_{csd}*T_{css}^2+i*T_{css}*T_{csd}^2+j*T_{csd}^3$$

Aspect 23. The HVAC compressor prognostics system in accordance with any of aspects 15-22, wherein the prognostic-diagnostic unit is further configured for determining a ratio between motor input power and mapped input power.

Aspect 24. The HVAC compressor prognostics system in accordance with any of aspects 15-23, wherein the prognostic-diagnostic unit is further configured to transmit a fault signal if the ratio between the motor input power and the mapped input power exceeds a predetermined ratio.

Aspect 25. The HVAC compressor prognostics system in accordance with any of aspects 15-24, wherein the prognostic-diagnostic unit is further configured to transmit a second fault signal if the ratio between the motor input power and the mapped input power exceeds a second predetermined ratio.

Aspect 26. The HVAC compressor prognostics system in accordance with any of aspects 15-24, the prognostic-diagnostic unit further comprising a memory device, wherein the prognostic-diagnostic unit is further configured to store historical information including at least one of a timestamp, information indicative of the actual input power of the electric motor, information indicative of the compressor speed, information indicative of the compressor saturated discharge temperature, and/or information indicative of the compressor saturated suction temperature in the memory device if the ratio between the motor input power and the mapped input power exceeds a predetermined ratio.

Aspect 27. The HVAC compressor prognostics system in accordance with any of aspects 15-25, wherein the prognostic-diagnostic unit is further configured to transmit historical information from the memory device.

Aspect 28. An HVAC compressor prognostic-diagnostic unit, comprising a mapping unit configured to receive a saturated suction pressure signal, a saturated discharge pressure signal, and a motor speed signal, the mapping unit further configured to compute a mapped power from the saturated suction pressure signal, a saturated discharge pressure signal, and a motor speed signal; a power determination unit configured to compute a motor input power; a comparison unit operatively coupled to the mapping unit and the power determination unit and configured to receive the mapped power and the motor input power, the comparison unit further configured to compare the motor input power to the mapped motor input power to determine an operational condition of the compressor; a memory unit operatively coupled to the comparison unit and configured to store the operational condition of the compressor; and an output unit operatively coupled to the comparison unit and/or the memory unit and configured to transmit the operational condition of the compressor.

Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. An HVAC compressor prognostics system, comprising:

a compressor having an inlet and an outlet;

an electric motor operatively coupled to the compressor;

a suction pressure sensor operatively coupled to the inlet of the compressor;

a discharge pressure sensor operatively coupled to the outlet of the compressor;

a motor speed indicator operatively coupled to the electric motor;

a motor input power indicator operatively coupled to the electric motor; and a prognostic-diagnostic unit coupled to the suction pressure sensor, the discharge pressure sensor, the motor speed indicator, and the motor input power indicator, wherein the prognostic-diagnostic unit determines an expected input power from a suction pressure signal received from the suction pressure sensor, a discharge pressure signal received from the discharge pressure sensor, and a motor speed signal received from the motor speed indicator, and wherein the prognostic-diagnostic unit compares the expected input power to the motor input power indicated by the motor input power indicator to determine compressor health.

2. The HVAC compressor prognostics system in accordance with claim 1, wherein the motor speed indicator is included in an inverter drive coupled to the electric motor.

3. The HVAC compressor prognostics system in accordance with claim 1, wherein the motor input power indicator is included in an inverter drive coupled to the electric motor.

4. The HVAC compressor prognostics system in accordance with claim 1, wherein the prognostic-diagnostic unit maps the compressor discharge pressure to a compressor discharge temperature.

5. The HVAC compressor prognostics system in accordance with claim 1, wherein the prognostic-diagnostic maps the compressor suction pressure to a compressor suction temperature.

6. The HVAC compressor prognostics system in accordance with claim 1, wherein the motor input power indicator provides the input current of the electric motor and the input voltage of the electric motor.

7. The HVAC compressor prognostics system in accordance with claim 1, wherein the prognostic-diagnostic unit calculates the expected input power in accordance with the equation:

$$P_{mapped}=a+b*T_{css}+c*T_{csd}+d*T_{css}^{2}+e*T_{css}*T_{csd}+f*T_{csd}^{2}+g*T_{css}^{3}+h*T_{csd}*T_{css}^{2}+i*T_{css}*T_{csd}^{2}+j*T_{csd}^{3}.$$

8. The HVAC compressor prognostics system in accordance with claim 1, wherein the prognostic-diagnostic unit determines a ratio between motor input power and expected input power.

9. The HVAC compressor prognostics system in accordance with claim 8, wherein the prognostic-diagnostic unit transmits a fault signal if the ratio between the motor input power and the mapped input power exceeds a predetermined ratio.

10. The HVAC compressor prognostics system in accordance with claim 9, wherein the prognostic-diagnostic unit is further transmits a second fault signal if the ratio between the motor input power and the mapped input power exceeds a second predetermined ratio.

11. The HVAC compressor prognostics system in accordance with claim 8, wherein the prognostic-diagnostic unit further comprises a memory that stores historical information including at least one of a timestamp, information indicative of the actual input power of the electric motor, information indicative of the compressor speed, information indicative of the compressor saturated discharge temperature, and information indicative of the compressor saturated suction temperature in the memory device when the ratio between the motor input power and the expected input power exceeds a predetermined ratio.

12. The HVAC compressor prognostics system in accordance with claim 11, wherein the prognostic-diagnostic unit transmits the historical information.

* * * * *